US007368684B2

(12) United States Patent
Kim et al.

(10) Patent No.: US 7,368,684 B2
(45) Date of Patent: May 6, 2008

(54) COOKING DEVICE

(75) Inventors: Jong Sik Kim, Koyang-si (KR); Kyu In Shim, Uiwang-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/392,753

(22) Filed: Mar. 30, 2006

(65) Prior Publication Data

US 2006/0237425 A1 Oct. 26, 2006

(30) Foreign Application Priority Data

Mar. 31, 2005 (KR) ..... 10-2005-0027152

(51) Int. Cl.
*F27D 7/04* (2006.01)
*F24C 15/04* (2006.01)
*F24C 15/32* (2006.01)

(52) U.S. Cl. ..... 219/400; 219/391; 126/21 A; 126/198; 126/287; 99/474

(58) Field of Classification Search ..... None
See application file for complete search history.

(56) References Cited

U.S. PATENT DOCUMENTS 3,911,893 A * 10/1975 Baker et al. ..... 126/21 A
5,387,258 A * 2/1995 Puricelli ..... 126/21 A
5,918,589 A * 7/1999 Valle et al. ..... 126/193
6,864,468 B2 3/2005 Kim et al.
6,904,904 B2 * 6/2005 Walther et al. ..... 126/198
6,967,310 B2 * 11/2005 Austin et al. ..... 219/391
7,060,940 B2 * 6/2006 Kim et al. ..... 219/400
2005/0045627 A1 3/2005 Kim et al.
2005/0092746 A1 5/2005 Song et al.
2005/0133019 A1 6/2005 Kim et al.

FOREIGN PATENT DOCUMENTS

EP 1120607 A2 * 8/2001
KR 10-2003 0059877 7/2003

* cited by examiner

*Primary Examiner*—Joseph M. Pelham
(74) *Attorney, Agent, or Firm*—Greenblum & Bernstein, P.L.C.

(57) ABSTRACT

A cooking device includes a cabinet, a cavity installed in the cabinet and having a cooking chamber therein, a door installed at the cabinet to open and close the cooking chamber, a ventilation passage formed to allow external air of the cabinet to pass through between the cavity and the cabinet so as to be discharged, a blower installed in the ventilation passage, and a cooking chamber air discharge unit for discharging air from the interior of the cooking chamber through the ventilation passage. Because the heated air inside the cooking chamber can be cooled by air which passes through the ventilation passage and then discharged, when the door is opened, heated air cannot be directly discharged to a user from the cooking chamber.

18 Claims, 9 Drawing Sheets

COOKING DEVICE

BACKGROUND OF THE INVENTION

1. Field of the Invention

The present invention relates to a cooking device such as a microwave oven and, more particularly, to a cooking device capable of mixing heat generated as cooking or pyrolysis cleaning is performed in a cooking chamber with external cold air sucked to an electronic equipment chamber and discharging cooled air when its door is opened following the cooking or pyrolysis cleaning.

2. Description of the Related Art

FIG. 1 is a partially cut perspective view of a cooking device in accordance with a related art, FIG. 2 is a side sectional view of the cooking device with its door closed in accordance with the related art, and FIG. 3 is a side sectional view of the cooking device when its door is opened in accordance with the related art.

The cooking device as shown in FIGS. 1 to 3 includes a cabinet 1, a cooking chamber 2 provided in the cabinet 1 and is heated to perform cooking on a food item, a door 7 installed at a front side of the cabinet 1 and opening and closing the cooking chamber 2, an electronic equipment chamber 3 positioned at an upper space of the cooking chamber 2 in the cabinet 3, and a blower 4 for cooling electronic components or the like inside the electronic equipment chamber 3.

The cooking chamber 2 is heated by an electric heater 2' or a burner and the like.

The blower 4 forms a self-cooking passage under the condition of high temperature generated when cooking or pyrolysis cleaning is performed, and generally includes a fan 5 and a fan motor 6 for driving the fan 5.

As indicated by arrows in FIG. 2, during cooking or pyrolysis cleaning, the blower 4 installed at a rear side in the electronic equipment chamber 3 sucks to supply external cold air to the electronic equipment chamber 3 through a space positioned at a lower portion of the cooking chamber 2 and then a space positioned at a rear portion of the cooking chamber 2, and discharges heat present in the electronic equipment chamber 3 to a front side of the cooking chamber 2 where the door 7 is positioned, thereby cooling air in the electronic equipment chamber 3.

Since the door 7 is directly heated by heat radiated and convected inside the cooking chamber 2, a cooling passage 7' is formed therein to prevent a user from being burned.

Regarding the cooling passage 7' of the door 7, when air is discharged from the electronic equipment chamber 3 by the blower 4, external air is sucked through a lower portion of the door 7 according to Bernoulli's equation using a velocity difference of an exhaust air flow and then discharged together with heat discharged from the electronic equipment chamber 3.

However, the related art cooking device has the following problems.

That is, since the door 7 is cooled merely by the natural convection according to the Bernoulli's equation, the door 7 cannot be sufficiently cooled, and if the blowing power of the blower 4 is degraded as the blower 4 is used for a long time, heat discharged from the electronic equipment chamber 3 could flow backward to the cooling passage 7' of the door 7, much degrading cooling performance of the door 6.

In particular, when pyrolysis cleaning is performed, the temperature inside the cooking chamber 2 is controlled to be increased up to above 450° C. to pyrolyze dirt smudged inside the cooking chamber 2, for which, however, the cooling structure of the door 7 as stated above cannot suitably cope with the high temperature, so the surface temperature of the door 7 is increased up to above 130°.

In addition, when the user opens the door 7 following the cooking or the pyrolysis cleaning, as shown in FIG. 3, the face of the user is bound to be directly exposed to the internal air of the cooking chamber 2. In this case, the internal air of the cooking chamber 2 is in a high temperature and high pressure state, including oil and moisture discharged from a food item therein, making the user feel uncomfortable, and in a worse case, a security problem, for example, the user could be burned, can arise.

SUMMARY OF THE INVENTION

The present invention is designed to solve such a problem of the related art, and therefore, one object of the present invention is to provide a cooking device capable of preventing a user from being directly exposed to heat of a cooking chamber when the user opens a door of the cooking device.

Another object of the present invention is to provide a cooking device capable of enhancing cooling efficiency of its door.

Still another object of the present invention is to provide a cooking chamber capable of preventing a user from being exposed to heat of a cooking chamber with a simple structure.

To achieve the above objects, there is provided a cooking device comprising: a cabinet; a cavity installed in the cabinet and having a cooking chamber therein; a door installed at the cabinet to open and close the cooking chamber; a ventilation passage formed to allow external air of the cabinet to pass through between the cavity and the cabinet so as to be discharged; a blower installed in the ventilation passage; and a cooking chamber air discharge unit for discharging air from the interior of the cooking chamber through the ventilation passage.

The cooking chamber air discharge unit comprises a communicating passage for connecting the interior of the cavity with the ventilation passage; and a valve for opening and closing the communicating passage.

The communicating passage is formed in an opened state at at least one side of a front portion or a rear portion of the cavity.

The communicating passage is formed to be opened up and down at an upper surface portion of the cavity.

The valve is a solenoid valve installed to open and close the connecting passage.

The cooking chamber air discharge unit further comprises a filter installed at the communicating passage.

The cooking chamber air discharge unit further comprises a door switch for sensing opening and closing of the door so that the valve can open the communicating passage when the door is opened.

The valve comprises a valve body disposed to open and close the communicating passage, a valve spring for elastically supporting the valve body in a direction that the communicating passage is opened, and a push rod for pressing the valve body in a direction that the communicating passage is shut tight when the door is closed.

The door further comprises a suction channel for guiding external air to flow along the ventilation passage after passing through the door, and a discharge channel for guiding air, which has passed along the ventilation passage, to be discharged outwardly after passing through the door.

The suction channel is formed at a front side of the discharge channel.

To achieve the above objects, there is also provided a cooking device comprising: a cabinet; a cavity installed in the cabinet and having a cooking chamber therein; an electronic equipment part installed in the cabinet; a door installed at the cabinet to open and close the cooking chamber; a ventilation passage formed to allow external air to sink heat of the electronic equipment part and then be discharged to outside; a blower installed in the ventilation passage; and a cooking chamber air discharge unit for discharging air from the interior of the cooking chamber through the ventilation passage.

The cooking chamber air discharge unit comprises a communicating passage for connecting the interior of the cavity with the ventilation passage; and a valve for opening and closing the communicating passage.

The communicating passage is formed in an opened state at at least one side of a front portion or a rear portion of the cavity.

The communicating passage is formed to be opened up and down at an upper surface portion of the cavity.

The valve is a solenoid valve installed to open and close the connecting passage.

The cooking chamber air discharge unit further comprises a filter installed at the communicating passage.

The cooking chamber air discharge unit further comprises a door switch for sensing opening and closing of the door so that the valve can open the communicating passage when the door is opened.

The electronic equipment part controls the solenoid valve and the blower according to a sensing result of the door switch.

The valve comprises a valve body disposed to open and close the communicating passage, a valve spring for elastically supporting the valve body in a direction that the communicating passage is opened, and a push rod for pressing the valve body in a direction that the communicating passage is shut tight when the door is closed.

To achieve the above objects, there is also provided a cooking device comprising: a cabinet; a cavity installed in the cabinet and having a cooking chamber therein; a ventilation passage formed to allow external air to pass through between the cavity and the cabinet so as to be discharged; a blower installed in the ventilation passage; a cooking chamber air discharge unit for discharging air from the interior of the cooking chamber through the ventilation passage; and door installed at the cabinet to open and close the cooking chamber and comprising a suction channel for guiding external air to flow to the ventilation passage after passing through the door and a discharge channel for guiding the air, which has passed through the ventilation passage, to pass through the door and then be externally discharged.

The cooking device in accordance with the present invention has many advantages as follows.

First, since air in the cooking chamber flows to the ventilation passage formed between the cabinet and the cavity by the cooking chamber air discharge unit and is cooled by air which passes through the ventilation passage and then discharged, when a user opens the door, high temperature air inside the cooking chamber can be prevented from being directly discharged to the user.

Second, because the cooking chamber air discharge unit includes the communicating passage for connecting the interior of the cavity with the ventilation passage and the valve for opening and closing the communicating passage, cooking or pyrolyzing can be effectively performed in a closing mode of the valve, and high temperature air can be effectively cooled and discharged in an opening mode of the valve.

Third, since the filter is installed at the communicating passage, moisture of the high temperature air discharged from the cooking chamber can be filtered so as not to be discharged.

Fourth, because the communicating passage is formed in an opened state at the front side of the cavity and positioned near the door, when the door is opened following cooking or pyrolysis cleaning, air can be quickly sucked so as to be cooled by the ventilation passage before being discharged to the front side of the cooking chamber.

Fifth, because the communicating passage is also formed in an opened state at the rear side of the cavity, high temperature air can be quickly sucked to the ventilation passage and cooled while cooking or pyrolysis cleaning is being performed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

A cooking device in accordance with preferred embodiments of the present invention will be described with reference to the accompanying drawings.

The embodiments of the present invention will now be described in detail with reference to the accompanying drawings.

Figure 4:
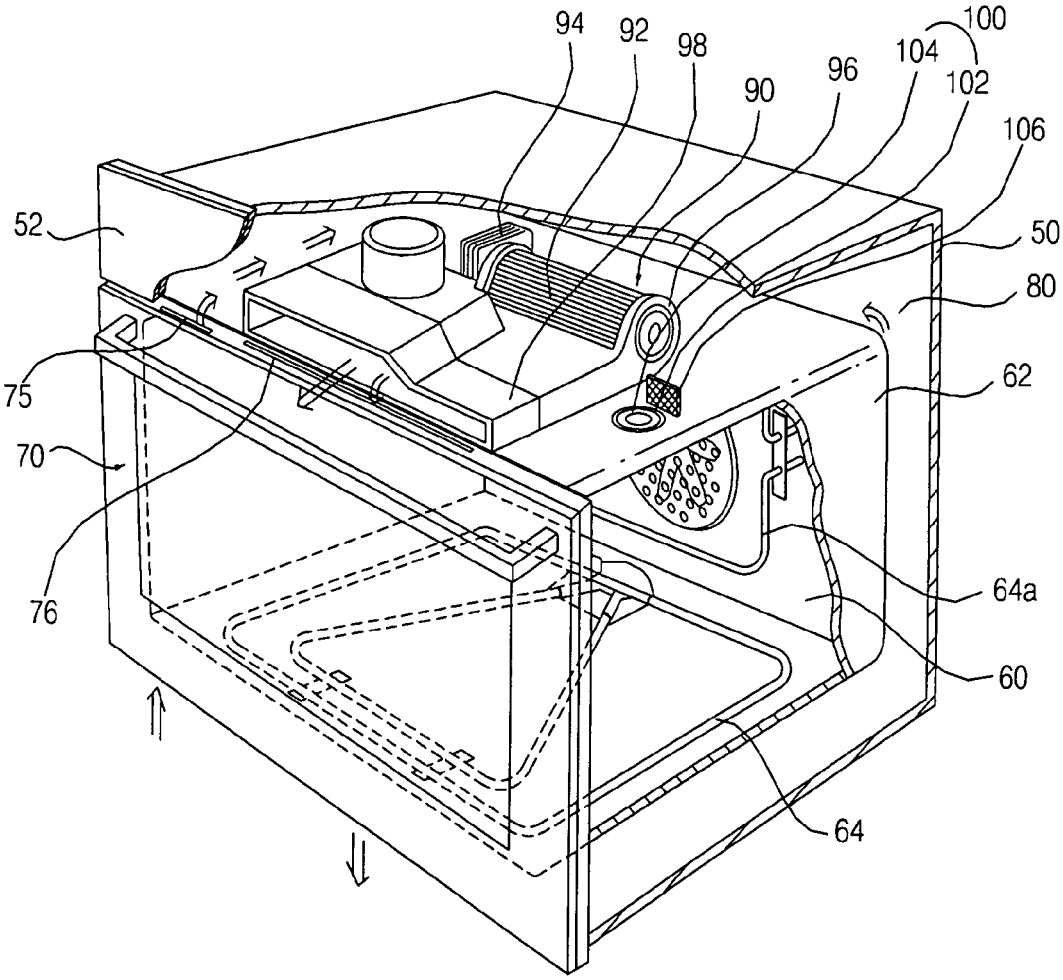
FIG. 4 is a partially cut perspective view of a cooking device in accordance with one embodiment of the present invention.
Figure 5:
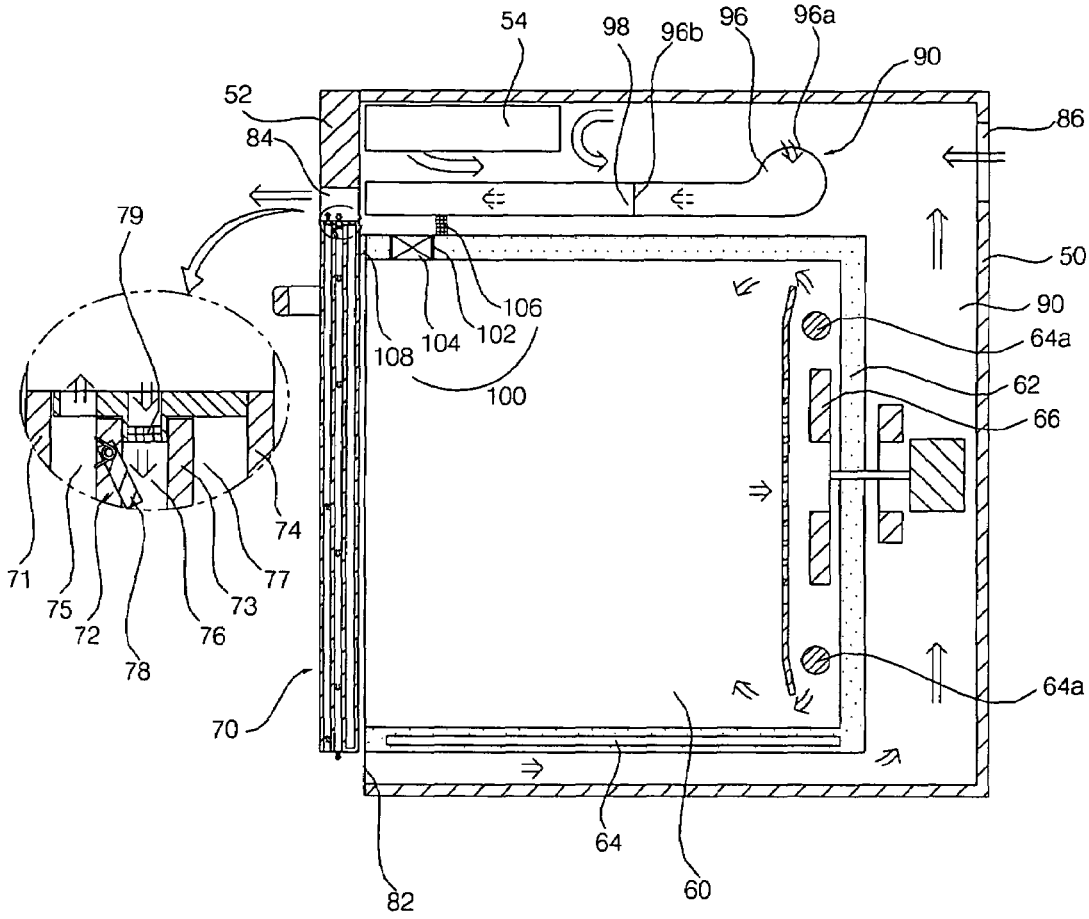
FIG. 5 is a side sectional view of the cooking device with its door closed in accordance with one embodiment of the present invention.
Figure 6:
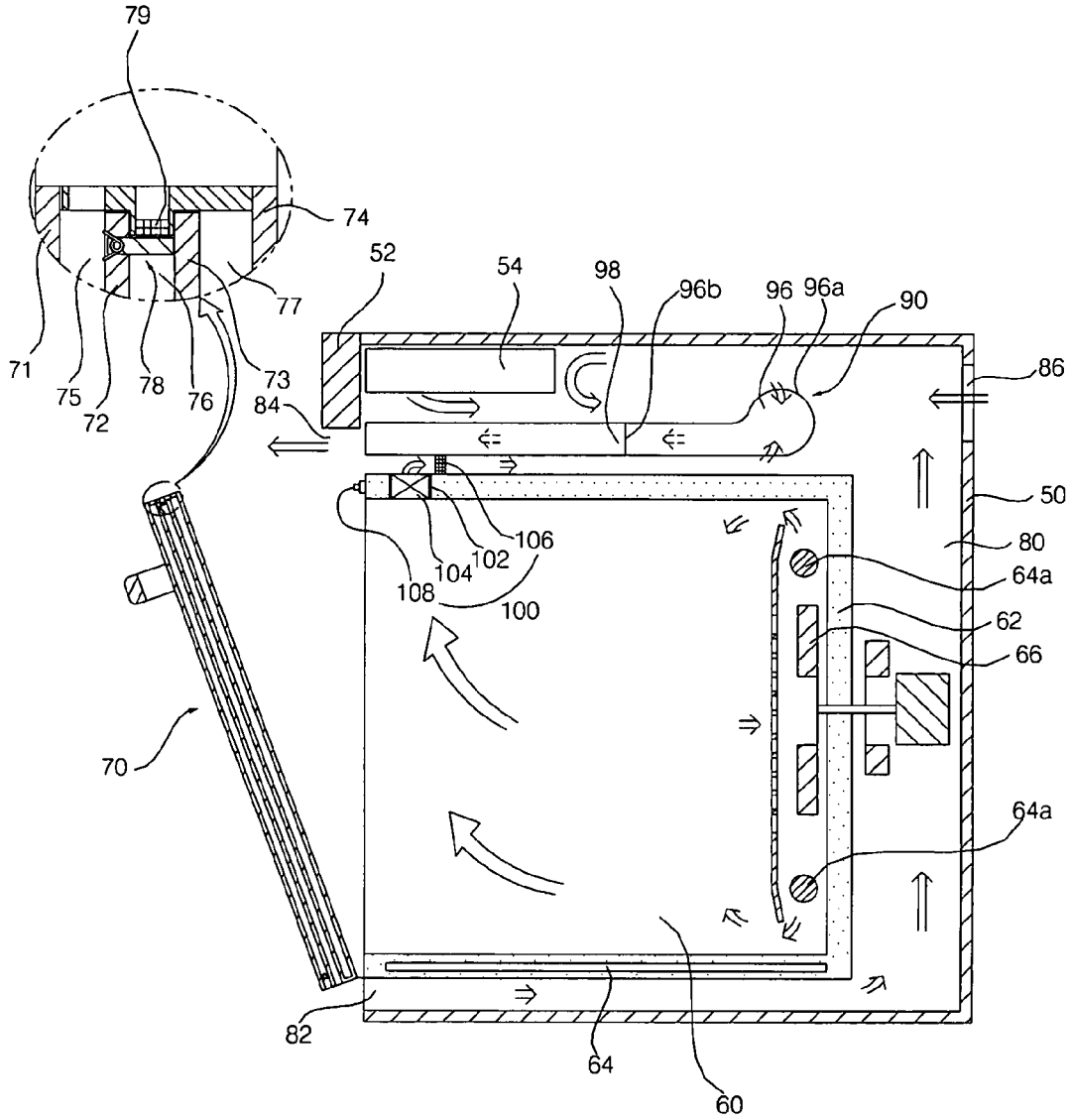
FIG. 6 is a side sectional view of the cooking device with its door opened in accordance with one embodiment of the present invention.

FIG. 4 is a partially cut perspective view of a cooking device in accordance with one embodiment of the present invention, FIG. 5 is a side sectional view of the cooking device with its door closed in accordance with one embodiment of the present invention, and FIG. 6 is a side sectional view of the cooking device with its door opened in accordance with one embodiment of the present invention.

The cooking device in accordance with the present invention includes a cabinet 50 forming the exterior, a cavity 62 installed inside the cabinet 50 and having a cooking chamber therein 60, and a door 70 installed at the cabinet 50 to open and close the cooking chamber 60.

A control panel 52 is installed at an upper portion of a front surface of the cabinet 50 and an electronic equipment part 54 is installed at a rear side of the control panel 52 and controls various components, such as, for example, a heater 64, a motor 94 and a valve 104 (to be described), of the cooking device, according to manipulation of the control panel 52.

The heater 64 is installed on upper, lower and rear surfaces of the cooking chamber 60 at the cavity 62 to increase internal temperature of the cooking chamber 60.

A cooking chamber fan 66 is disposed at the cavity 62 in order to circulate air in the cooking chamber 60 to the heater 64, especially, to heaters 64*a* installed at the rear surface of the cooking chamber 60.

In the cooking device, a ventilation passage 80 is formed to allow external air of the cabinet 50 to pass between the cabinet 50 and the cavity 60 and then be discharged to outside, and a blower 90 is installed in the ventilation passage 80.

Herein, the ventilation passage 80 can be formed to allow external air to sink heat of the control panel 52 or the electronic equipment part 54, or can be formed to be partitioned separately from the control panel 52 or the electronic equipment part 54. In the present invention, the ventilation passage 80 will be described such that it is formed to allow external air to pass therethrough to sink heat of the control panel 52 or the electronic equipment part 54 and then be discharged.

The ventilation passage 80 is formed to allow external cold air to be sucked into a lower space of the cavity 62 and sequentially pass through the rear space and the upper space of the cavity 62, and then be outwardly discharged through a space between an upper end of the door 70 and a lower end of the control panel 52.

Namely, an air inlet 82 of the ventilation passage 80 is formed at a lower portion of the front side of the cooking device, and an air outlet 84 of the ventilation passage 80 is formed at a lower side of the control panel 52.

Preferably, the blower 90 is installed at an upper side of the cavity 62 so that air of the ventilation passage 80 can easily contact with the control panel 52 or the electronic equipment part 54 to cool them.

As shown in FIG. 4, the blower 90 includes a fan 92 for forcing air to flow in the ventilation passage 80 and the motor 94 for driving the fan 92.

Herein, the motor 94 can be controlled to rotate the fan 92 faster in the pyrolysis cleaning than in cooking, or can be controlled to rotate the fan 92 faster when the door 70 is opened than when the door 70 is in a closed state.

In addition, the motor 94 can be controlled to rotate the fan 92 whenever the door 70 is opened, or also can be controlled not to rotate the fan 92 when the door 70 is opened before cooking or the pyrolysis cleaning but to rotate the fan 92 when the door 70 is opened after cooking or the pyrolysis cleaning.

The blower 90 additionally includes a fan housing 96 which surrounds the fan 92 and includes a suction hole 96*a* for sucking air and a discharge hole 96*b*, and an air duct 98 installed to be connected with the discharge hole of the fan housing 96 so that air discharge through the discharge hole 96*b* can be guided to blow between the upper end of the door 70 and the lower end of the control panel 52.

A lower end of the door 70 is hinge-coupled at the cabinet 50, and opens and closes the cooking chamber 60 by being rotated forwardly and backwardly centering on the lower end hinge-coupled at the cabinet 50.

As shown in FIGS. 5 and 6, the door 70 includes a plurality of plate members 71~74. In order to be air-cooled by the blower 90, the plurality of plate members 71~74 are disposed at certain intervals to have cooling channels each communicating with the ventilation passage 80.

Herein, descriptions will be made such that the plurality of plate members 71~74 are disposed in the order starting from the outer side.

The cooling channels of the door 70 include a suction channel 75 for allowing external cold air to pass through the door 70 and then be sucked to the ventilation passage 80, and a discharge channel 76 allowing a portion of the air discharged from the ventilation passage 80 to pass through the door 70 and then discharge to outside of the cabinet 50.

Of the door 70, the suction channel 75 is formed at a front side of the discharge channel 76.

The reason for this is because the outer portion of the door 70 can directly contact with a user, so it needs to be sufficiently cooled not to cause a user to be burned, and the inner portion of the door 70 needs to be maintained at a higher temperature than the outer portion of the door 70 to minimize a heat loss of the cooking chamber 60.

Namely, in the door 70, the suction channel 75 is positioned between first and second plates 71 and 72, the discharge channel 76 is positioned between second and third plate members 72 and 73, and a channel 77 positioned between the third and fourth plate members 73 and 74 is sealed to minimize a heat loss of the cooking chamber 60.

A cooling channel valve 78 can be provided at the discharge channel 76 of the door 70 to selectively communicate with the ventilation passage 80, especially, with the air outlet 84.

The cooling channel valve 78 is opened or closed to communicate with the ventilation passage 80, especially with the air outlet 84, during only pyrolysis cleaning.

A door filter 79 can be installed at the discharge channel 76 of the door 70 to prevent contamination of the door 70 when air passes therethrough after being discharged from the ventilation passage 80, especially from the air outlet 84.

The cooking device includes a cooking chamber air discharge unit 100 for discharging air from the interior of the cooking chamber 60 through the ventilation passage 80.

The cooking chamber air discharge unit 100 includes a communicating passage 102 for connecting the cooking chamber 60 and the ventilation passage 80 and a valve 104 for opening and closing the communicating passage 102.

The communicating passage 102 is formed to communicate between the air inlet 82 and the blower 90 in the ventilation passage 80.

The communication passage 102 may include an opening formed at one side of the cavity 62 and a duct installed between the opening and the blower 90 to guide air discharged to the opening to the vicinity of the blower 90, or may be formed as the opening formed at one side of the cavity 62 to be connected with the ventilation passage 80. In the present invention, it will be described that the communicating passage 102 is formed as the opening formed at one side of the cavity 62.

Since the communicating passage 102 is formed as an opening at least at one side of the front and rear sides of the cavity 62, it is preferred that the communicating passage 102 is formed near the door 70 as close as possible so that when the door 70 is opened following cooking or the pyrolysis cleaning, air flowing toward the front side of the cooking chamber 60 can be quickly sucked into the ventilation passage 80 before being discharged to the front side of the cooking chamber 60.

Namely, the communicating passage 102 is formed to be opened up and down at an upper surface portion of the front side of the cavity 62.

The valve 104 is formed as a solenoid valve installed to open and close the communicating passage 102.

The valve 104 can be positioned at an upper side of the communicating passage 104 or can be positioned inside the communicating passage 102.

The valve 104 can be operated in an opening mode when the door is opened following cooking or pyrolysis cleaning, or can be operated in the opening mode during cooking or pyrolysis cleaning.

The cooking chamber air discharge unit 100 additionally includes a filter 106 for purifying air which has passed through the communicating passage 102 so that air can be sucked to the blower 90 after being purified thereby.

In case where the communicating passage 102 includes a duct, the filter 106 is preferably installed inside the duct. If the communicating passage 102 does not include a duct, the filter 106 is preferably installed between the valve 104 and the blower 90.

The cooking chamber air discharge unit 100 additionally includes a door switch 108 for sensing opening and closing of the door 70 so that the valve 104 can open the communicating passage 104 when the door 70 is opened.

The door switch 108 is installed at the front side of the cabinet 50 so that it can be turned on or off according to opening and closing of the door 70.

Reference numeral 86 denotes an air inlet formed at the rear side or at an upper portion, other than the front lower portion, of the cabinet 50 so that external air can be sucked to the ventilation passage 80 therethrough.

Figure 1:
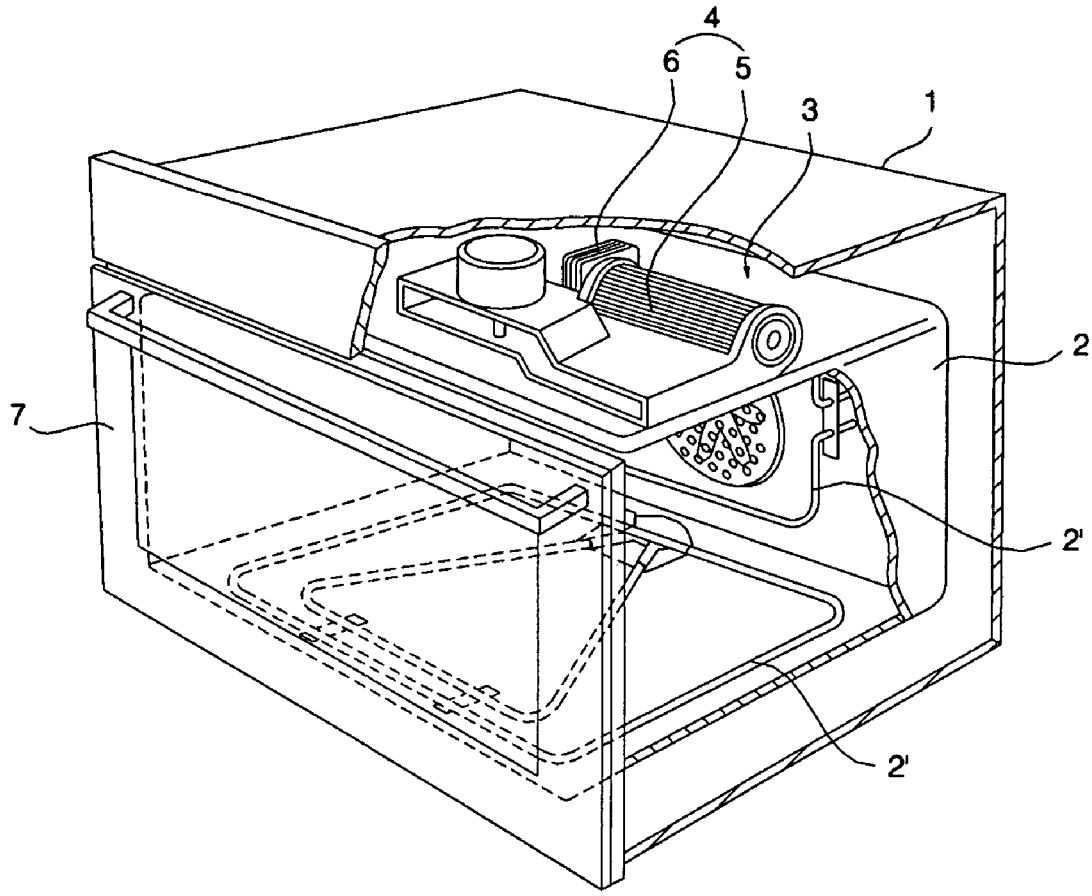
FIG. 1 (related art)
FIG. 1 is a partially cut perspective view of a cooking device in accordance with a related art.
Figure 2:
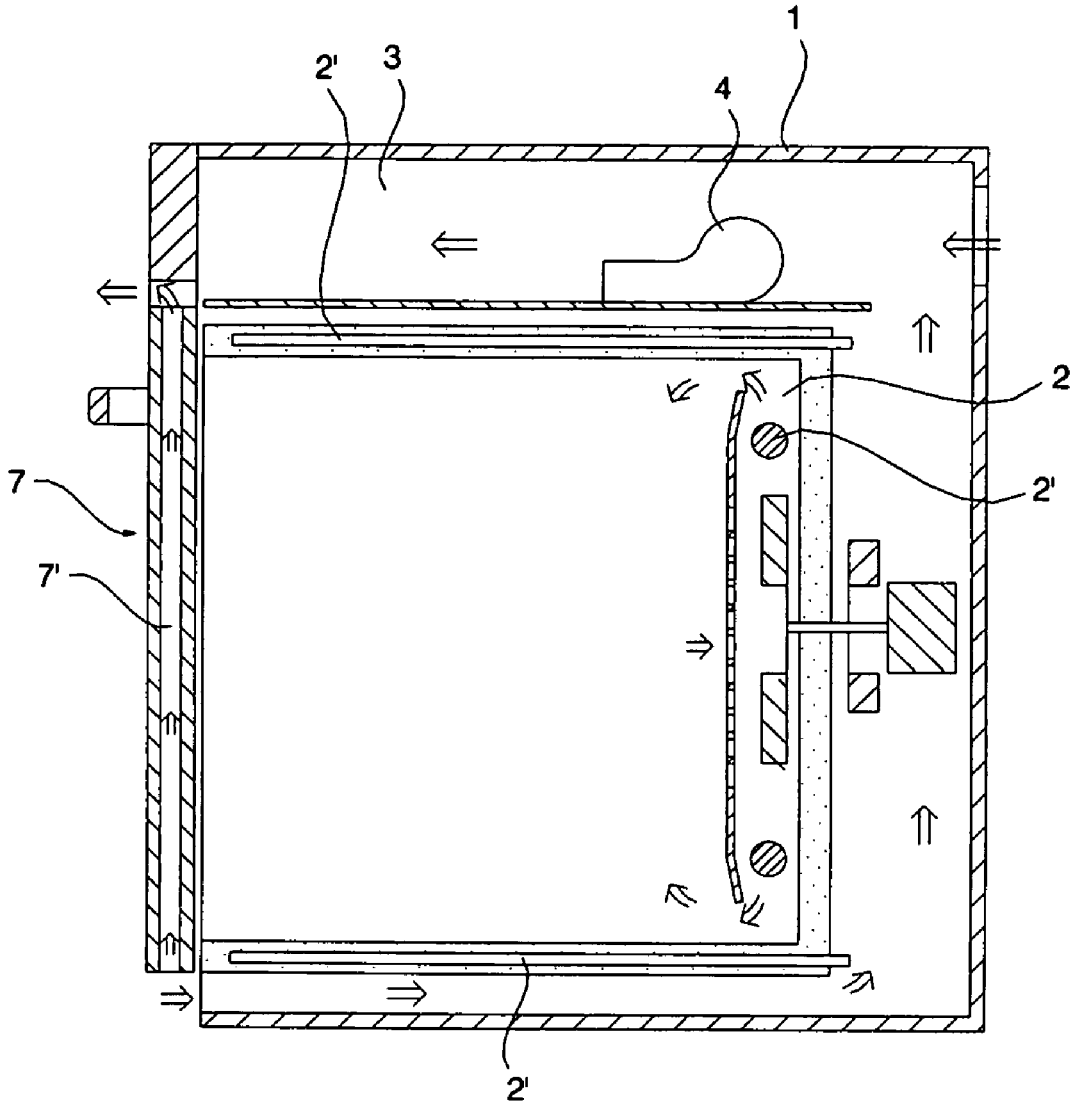
FIG. 2(related art)
FIG. 2 is a side sectional view of the cooking device with its door closed in accordance with the related art.
Figure 3:
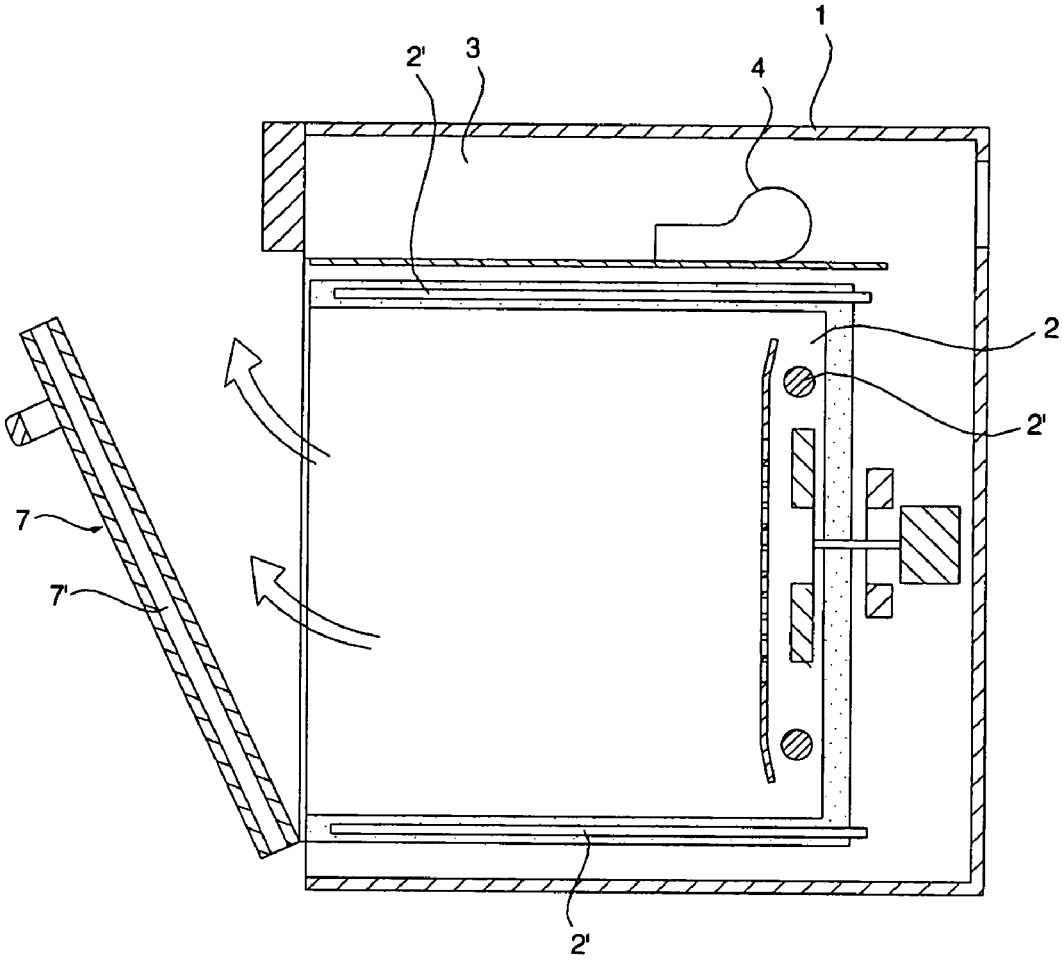
FIG. 3 (related art)
FIG. 3 is a side sectional view of the cooking device when its door is opened in accordance with the related art.

The operation of the cooking device in accordance with the present invention will be described with reference to FIGS. 3 and 4 as follows.

When the cooking device is operated in the cooking mode or in the pyrolysis cleaning mode, power is applied to heat the heater 64 and the cooking chamber fan 66 is rotated to circulate air inside the cooking chamber 60, according to which temperature of the interior of the cooking chamber 60 goes up to cook a food item positioned in the cooking chamber 60 or decompose smudged dirt in the cooking chamber 60.

When the cooking device is operated in the cooking mode or in the pyrolysis cleaning mode, the motor 94 of the blower 90 is driven always.

When the motor 94 is driven, the fan 92 is rotated, external air of the cabinet 50 is sucked into the ventilation passage 80 through the air inlets 82 and 86, and the sucked air cools the control panel 52 and the electronic equipment part 54 and is then outwardly discharged through the air outlet 84.

When the fan 92 is rotated, external air cools the door 70 as it passes through the suction channel 75 of the door 70 and is then sucked into the ventilation passage 80, and as a portion of air discharged to the air outlet 84 of the ventilation passage 80 passes through the discharge channel 76 of the door 70, the door is also cooled.

After the above process, when the cooking mode or the pyrolysis cleaning mode is stopped and the door 70 is opened, the valve 104 is opened.

In addition, in order for the blower 90 to generate stronger blowing force than in the cooking mode or in the pyrolysis cleaning mode, the motor 94 is driven and the fan 92 is rotated.

As the valve 104 is opened and the fan 92 of the blower 90 is rotated, air inside the cooking chamber 60 is sucked into the ventilation passage 80 through the communicating passage 102, rather than being discharge to the front side of the cooking chamber 60.

The air sucked into the ventilation passage 80 is mixed with air sucked through the air inlets 82 and 86 of the ventilation passage 80 so as to be cooled or mixed with air which has cooled the control panel 52 or the electronic equipment part 54 so as to be cooled, which sequentially passes through the blower 90, especially, the fan housing 96 and the air duct 98, and is then outwardly discharged through the air outlet 84.

Namely, in the cooking device, air with lower temperature is discharged than in the case where air inside the cooking chamber 60 is directly discharged to the front side of the cooking chamber 60.

Regarding the cooking chamber in accordance with another embodiment of the present invention, descriptions for other elements than the cooking chamber air discharge unit will be omitted and the cooking device described above with reference to FIGS. 3 to 5 will be referred.

Figure 7:
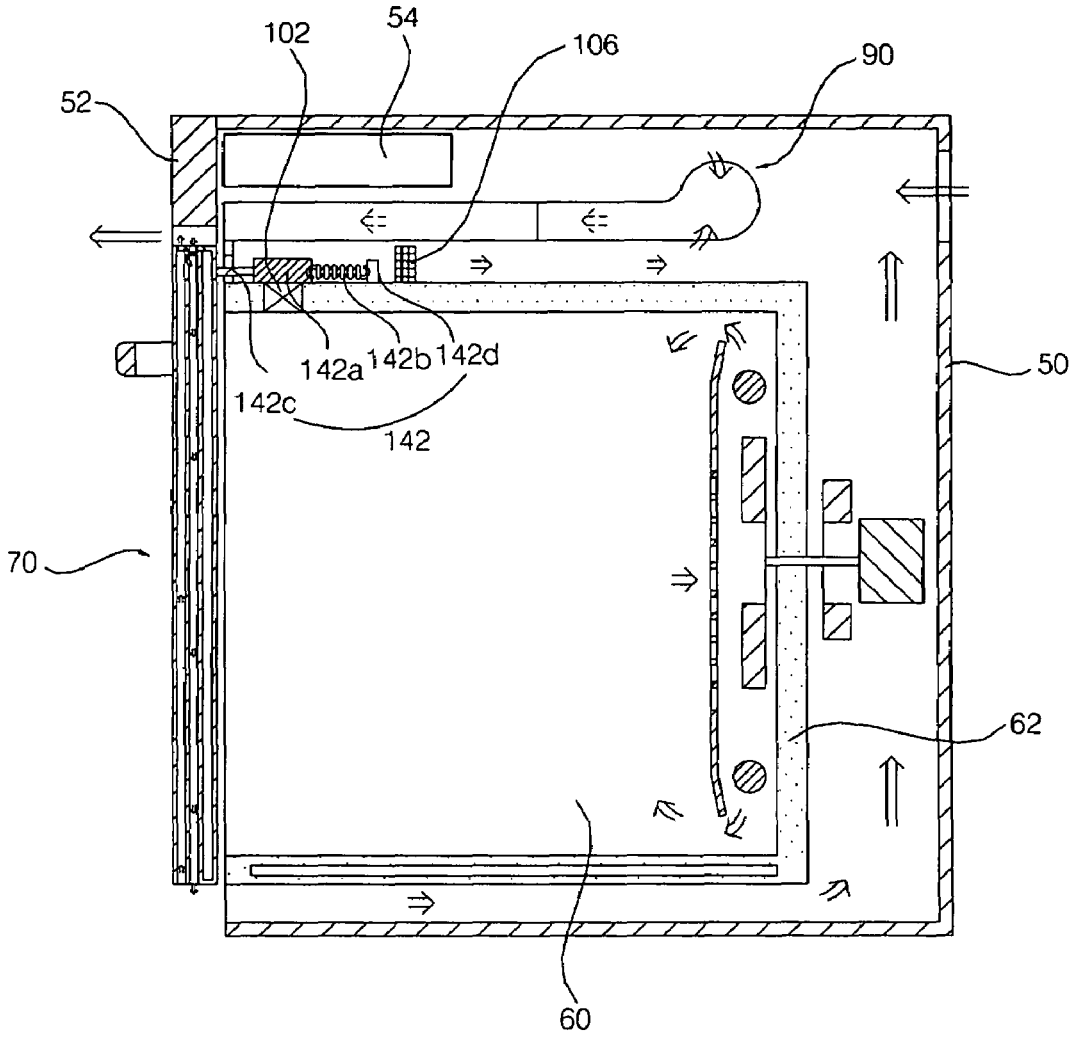
FIG. 7 is a sectional view showing a cooking chamber air discharge unit of the cooking device with its door closed in accordance with another embodiment of the present invention.
Figure 8:
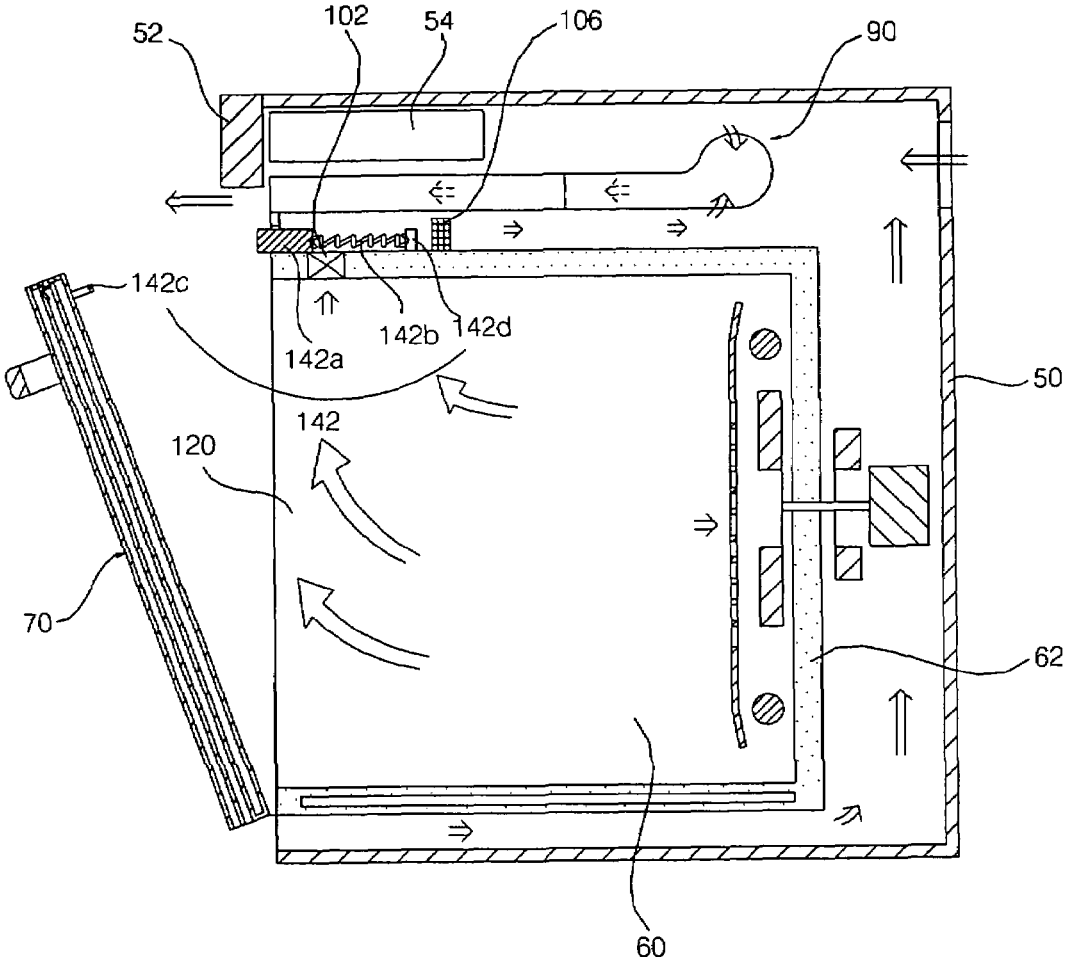
FIG. 8 is a sectional view showing a cooking chamber air discharge unit of the cooking device with its door opened in accordance with another embodiment of the present invention.

FIG. 7 is a sectional view showing a cooking chamber air discharge unit of the cooking device with its door closed in accordance with another embodiment of the present invention, and FIG. 8 is a sectional view showing a cooking chamber air discharge unit of the cooking device with its door opened in accordance with another embodiment of the present invention.

As shown in FIGS. 7 and 8, in the cooking chamber in another embodiment of the present invention, a valve 142 mechanically opens and closes a communicating passage 102 as the door 70 is opened or closed.

The valve 142 includes a valve body 142*a* disposed to slidably open and close the communicating passage 102, a valve spring 142*b* for elastically supporting the valve body 142*a* in a direction that the communicating passage 102 is opened, and a push rod 142*c* for pressing the valve body 142*a* in a direction that the communicating passage 102 is shut tight when the door 70 is closed.

The valve spring 142*b* is installed to be supported by a spring supporter 142*d* formed at the cavity 60.

The push rod 142*c* is formed to be protruded to face the rear surface of the door 70.

In the cooking device in accordance with another embodiment of the present invention, when the door 70 is closed, the push rod 142*c* presses the valve body 142*a* so as to be slidably moved backward and the valve body 142*a* presses the valve spring 142*b* to close the communicating passage 102. Then, because the communicating passage 102 is closed, air inside the cooking chamber 60 cannot be discharged through the blower 90.

Meanwhile, when the door 70 is opened, the push rod 142*c* does not press the valve body 142*a* and the valve body

142*a* is slidably moved forward by virtue of elastic force of the valve spring 142*a* and the communicating passage 102 is opened. Accordingly, since the communicating passage 102 is opened, air inside the cooking chamber can be discharged through the blower 90.

Figure 9:
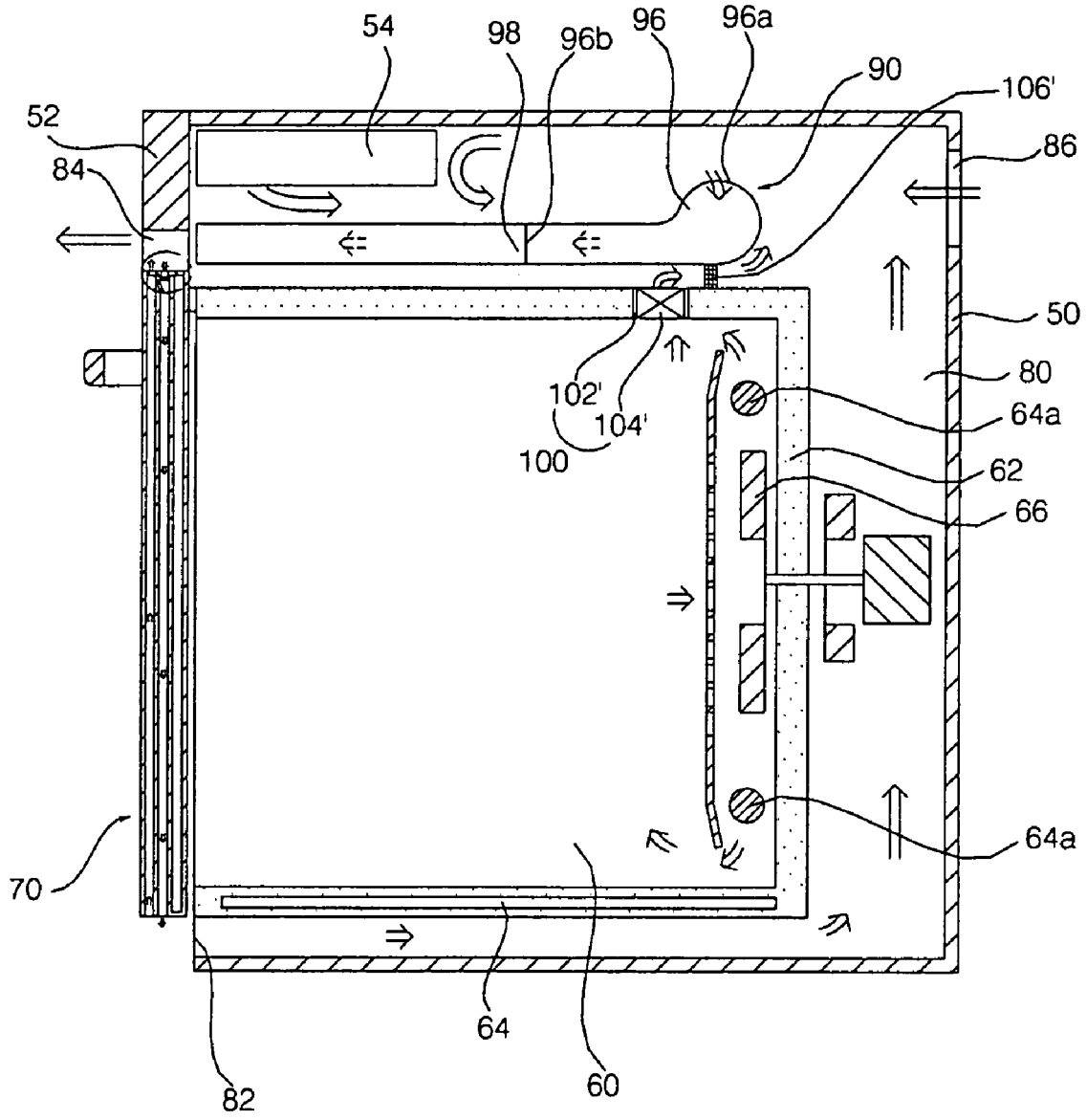
FIG. 9 is a sectional view of the cooking device in accordance with still another embodiment of the present invention.

FIG. 9 is a sectional view of the cooking device in accordance with still another embodiment of the present invention.

In the cooking device in accordance with this embodiment of the present invention, as shown in FIG. 9, a communicating passage 102' is formed at a rear side, especially, at an upper surface portion, of the cavity 62 and a valve 104' is installed to open and close the communicating passage 102'.

A filter 106' with a honeycomb structure can be installed to purify air which has passed through the communicating passage 102'.

In the cooking device, when pyrolysis cleaning is performed, the motor 94 of the blower 90 is driven to rotate the fan 92 of the blower 90, and the valve 104' is opened.

High temperature air in the cooking chamber 60 passes through the communicating passage 102' according to the rotation of the fan 92 and the opening of the valve 104'.

As the air, which has passed through the communicating passage 102', passes through the filter 106' with the honeycomb structure, pyrolyzed dirt is filtered by the filter 106' and only clean air flows to the ventilation passage 80 to be mixed with air sucked through the air inlets 82 and 86 of the ventilation passage 80 so as to be cooled, or mixed with air which has cooled the control panel 52 or the electronic equipment part 54 so as to be cooled.

Thereafter, the cooled air passes through the blower 90, especially, sequentially through the fan housing 96 and the air duct 98 and then is outwardly discharged through the air outlet 84.

The cooking device constructed as described above has the following effects.

First, since air in the cooking chamber is sent to the ventilation passage formed between the cabinet and the cavity by the cooking chamber air discharge unit, cooled by air passing through the ventilation passage, and then discharged outwardly, when the user opens the door, high temperature air can be prevented from being directly discharged toward the user.

Second, since the cooking chamber air discharge unit includes the communicating passage for connecting the interior of the cavity with the ventilation passage and the valve for opening and closing the communicating passage, cooking or pyrolysis cleaning can be effectively performed in the closing mode of the valve and high temperature air can be effectively cooled and discharged in the opening mode of the valve.

Third, since the filter is installed at the communicating passage, moisture of the high temperature air discharged from the cooking chamber can be filtered by the filter, without being discharged outwardly.

Fourth, since the communicating passage is formed to be opened at the front side of the cavity and positioned to be closed to the door, when the door is opened following cooking or pyrolysis cleaning, air in the cooking chamber can be quickly sucked into the ventilation passage and cooled before being discharged to the front side of the cooking chamber.

Fifth, since the communicating passage is formed to be opened at the rear side of the cavity, high temperature air generated during cooking and pyrolysis cleaning can be quickly sucked to the ventilation passage and cooled.

Sixth, since the valve is formed as the solenoid valve to open and close the communicating passage, it can be easily controlled and the structure for opening and closing the communicating passage is quite simple.

Seventh, because the switch is additionally provided to sense opening and closing of the door, to allow the valve to open the communicating passage when the door is opened, when the door is opened, air inside the cooking chamber can be automatically sucked, cooled and then discharged.

Eighth, because the valve includes the valve body disposed to open and close the communicating passage, the valve spring for elastically supporting the valve body in the direction that the communicating passage is opened and the push rod for pressing the valve body in the direction that the communicating passage is shut tight when the door is closed, the valve can be opened and closed through simple opening and closing of the door without any additional controlling.

Ninth, because the suction channel for guiding external air to flow to the ventilation passage after passing through the door and the discharge channel for externally discharging the air through the door after having passed through the ventilation passage are additionally provided, external air can cool the door while passing through the suction channel and as a portion of the air discharged from the ventilation passage passing through the discharge channel, it also cools the door again, increasing the cooling efficiency of the door.

Tenth, since the suction channel of the door is formed at the front side of the discharge channel of the door, the user can be prevented from getting burned, and a heat loss of the cooking chamber can be minimized.

The foregoing description of the preferred embodiments of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A cooking device comprising:

a cabinet;

a cavity installed in the cabinet and having a cooking chamber therein;

a door installed at the cabinet to open and close the cooking chamber;

an electronic equipment part installed in the cabinet;

a ventilation passage formed between the cavity and the cabinet to allow air external to the cabinet to pass through to absorb heat of the electronic equipment part and then be discharged;

an air inlet formed at the cabinet to allow external air to flow into the ventilation passage;

a blower installed in the ventilation passage; and a cooking chamber air discharger that discharges air from the interior of the cooking chamber through the ventilation passage, wherein the cooking chamber air discharger comprises:

a communicating passage that connects the interior of the cavity with the ventilation passage; and a valve that opens and closes the communicating passage.

2. The device of claim 1, wherein the communicating passage is formed in an opened state at at least one side of a front portion or a rear portion of the cavity.

3. The device of claim 1, wherein the communicating passage is formed to be opened up and down at an upper surface portion of the cavity.

4. The device of claim 1, wherein the valve is a solenoid valve installed to open and close the connecting passage.

5. The device of claim 1, wherein the cooking chamber air discharge unit further comprises a filter that purifies air passing through the communicating passage.

6. The device of claim 5, wherein the cooking chamber air discharger further comprises a door switch that senses opening and closing of the door so that the valve can open the communicating passage when the door is opened.

7. The device of claim 1, wherein the valve comprises a valve body disposed to open and close the communicating passage, a valve spring that elastically supports the valve body in a direction that the communicating passage is opened, and a push rod that presses the valve body in a direction that the communicating passage is shut tight when the door is closed.

8. The device of claim 1, wherein the door further comprises:

a suction channel that guides external air to flow along the ventilation passage after passing through the door; and a discharge channel that guides air, which has passed along the ventilation passage, to be discharged outwardly after passing through the door.

9. The device of claim 8, wherein the suction channel is formed at a front side of the discharge channel.

10. A cooking device comprising:

a cabinet;

a cavity installed in the cabinet and having a cooking chamber therein;

an electronic equipment part installed in the cabinet;

a ventilation passage formed to allow external air to sink heat of the electronic equipment part and then be discharged to outside;

a door installed at the cabinet to open and close the cooking chamber, the door having a vertical discharge channel that guides air, which has passed along the ventilation passage, to pass through the door and then be externally discharged;

a blower installed in the ventilation passage; and a cooking chamber air discharger that discharges air from the interior of the cooking chamber through the ventilation passage, wherein the cooking chamber air discharger comprises:

a communicating passage that connects the interior of the cavity with the ventilation passage; and a valve that opens and closes the communicating passage.

11. The device of claim 10, wherein the communicating passage is formed in an opened state at at least one side of a front portion or a rear portion of the cavity.

12. The device of claim 10, wherein the communicating passage is formed to be opened up and down at an upper surface portion of the cavity.

13. The device of claim 10, wherein the valve is a solenoid valve installed to open and close the connecting passage.

14. The device of claim 10, wherein the cooking chamber air discharger further comprises a filter that purifies air passing through the communicating passage.

15. The device of claim 10, wherein the cooking chamber air discharger further comprises a door switch that senses opening and closing of the door so that the valve can open the communicating passage when the door is opened.

16. The device of claim 10, wherein the electronic equipment part controls the solenoid valve and the blower according to a sensing result of the door switch.

17. The device of claim 10, wherein the valve comprises a valve body disposed to open and close the communicating passage, a valve spring that elastically supports the valve body in a direction that the communicating passage is opened, and a push rod that presses the valve body in a direction that the communicating passage is shut tight when the door is closed.

18. A cooking device comprising:

a cabinet;

a cavity installed in the cabinet and having a cooking chamber therein;

a ventilation passage formed to allow external air to pass through between the cavity and the cabinet so as to be discharged;

a blower installed in the ventilation passage;

a cooking chamber air discharger that discharges air from the interior of the cooking chamber through the ventilation passage; and a door installed at the cabinet to open and close the cooking chamber and comprising a suction channel that guides external air to flow to the ventilation passage after passing through the door and a discharge channel that guides the air, which has passed through the ventilation passage, to pass through the door and then be externally discharged.

* * * * *